US005286169A

United States Patent [19]

Dinh et al.

[11] Patent Number: 5,286,169

[45] Date of Patent: Feb. 15, 1994

[54] BUCKET FOR THE NEXT-TO-LAST STAGE OF A STEAM TURBINE

[75] Inventors: Cuong V. Dinh, Schenectady; Stephen G. Ruggles, Scotia; Chic S. Yang, Schenectady, all of N.Y.

[73] Assignee: General Electric Company, Schenectady, N.Y.

[21] Appl. No.: 991,545

[22] Filed: Dec. 15, 1992

[51] Int. Cl.[5] ..... F01D 5/14

[52] U.S. Cl. ..... 416/223 A; 416/DIG. 2

[58] Field of Search ..... 416/223 A, DIG. 2, 243

[56] References Cited

U.S. PATENT DOCUMENTS

| | | | |
|---|---|---|---|
| 4,900,230 | 2/1990 | Patel | 416/223 A |
| 5,088,894 | 2/1992 | Patel | 416/223 A |

FOREIGN PATENT DOCUMENTS

| | | | |
|---|---|---|---|
| 0516440 | 9/1955 | Canada | 416/243 |
| 0112003 | 6/1984 | European Pat. Off. | 416/DIG. 2 |
| 1940583 | 2/1971 | Fed. Rep. of Germany | 416/243 |
| 2151841 | 4/1973 | Fed. Rep. of Germany | 416/DIG. 2 |
| 0123301 | 9/1990 | Japan | 416/DIG. 2 |

*Primary Examiner*—Edward K. Look
*Assistant Examiner*—Mark Sgantzos
*Attorney, Agent, or Firm*—Nixon & Vanderhye

[57] ABSTRACT

A last-stage steam turbine bucket having an actual and theoretical profile according to Charts II-XVI. The last-stage turbine bucket has a theoretical profile according to Charts I-XVII.

2 Claims, 2 Drawing Sheets

BUCKET FOR THE NEXT-TO-LAST STAGE OF A STEAM TURBINE

TECHNICAL FIELD

The present invention relates to turbines, particularly steam turbines, and particularly relates to a next-to-last stage steam turbine bucket having improved aerodynamic efficiency.

BACKGROUND

Buckets for steam turbines have for some time been the subject of substantial developmental work. It is highly desirable to optimize the performance of these buckets to reduce aerodynamic losses. Optimally, the bucket profile should be designed to match aerodynamically the flow of the nozzle to provide the desirable operating characteristics over a large operating range. Factors which affect the bucket profile design include the active length of the bucket, the pitch diameter and the operating speed in subsonic flows. Damping and bucket fatigue are factors which must be considered in the mechanical design of the bucket. The buckets must also be tuned to avoid coincidence between their natural frequencies and the flow stimuli. These mechanical and dynamic response properties of the buckets as well as others, such as thermodynamic properties or material selection all influence the optimum bucket profile. In brief, next-to-last stage steam turbine buckets require a precisely defined bucket profile for optimal aerodynamic performance with minimum losses over a wide operating range.

Appropriate bucket profile design is also important to provide axially convergent flow passages between adjacent buckets to achieve maximum aerodynamic efficiency. Bucket designs in the past have also included coupling of groups of buckets at their outer tips employing covers. These couplings are used in the present bucket to reduce bucket response to stimuli in the working fluid, which could cause uncontrolled vibration of the buckets, for example, at their natural frequencies. Vibration, of course, is to be minimized or eliminated to avoid fatigue, crack initiation and eventual structural failure and these continuous couplings, of course, affect the aerodynamic properties of the buckets. It is important also for the covers to provide a seal at the tips of the buckets to minimize aerodynamic loss resulting from flow passing around the bucket tips.

DISCLOSURE OF INVENTION

In accordance with the present invention, there is provided a bucket profile design for a bucket of a steam turbine which affords significantly enhanced aerodynamic performance and efficiencies and reduced losses while providing for (1) convergent flow passages; (2) substantially improved blade incidence loss; (3) reduced section edge thickness; and (4) optimized flow distribution. The present design affords desired flow characteristics for buckets used in the next-to-the-last stage of a steam turbine.

In a preferred embodiment according to the present invention, there is provided a bucket for a steam turbine having a profile in accordance with Charts II–XVI.

In a further preferred embodiment according to the present invention, there is provided a bucket for a steam turbine having a profile in accordance with the Charts I–XVII.

Accordingly, it is a primary object of the present invention to provide a novel and improved bucket for the next-to-the-last stage of a steam turbine having improved aerodynamic performance.

BEST MODE FOR CARRYING OUT THE INVENTION

Reference will now be made in detail to a present preferred embodiment of the invention, an example of which is illustrated in the accompanying drawings.

Figure 1:
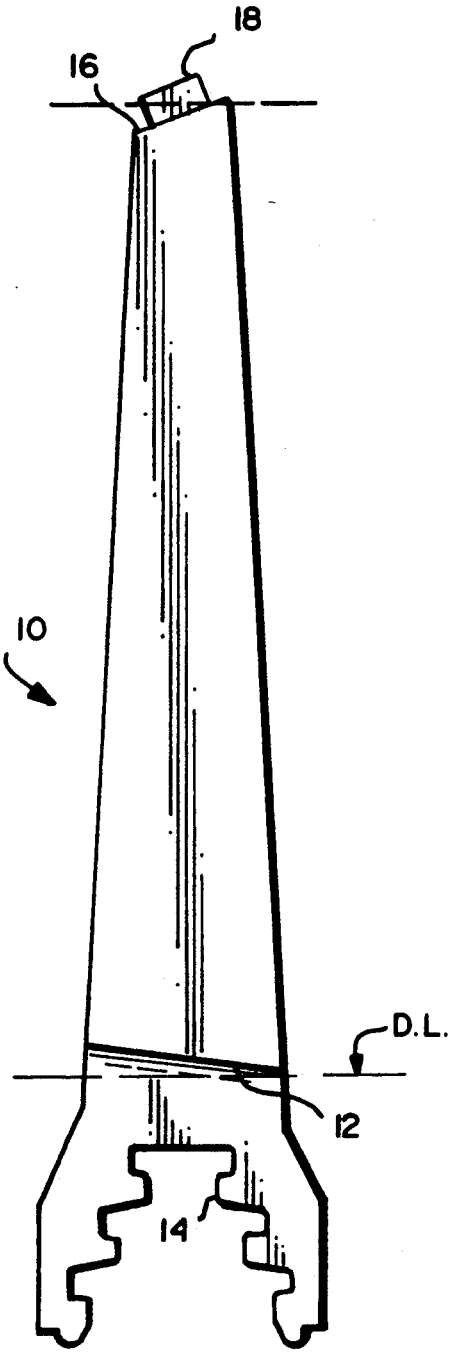
FIGS. 1 and 2 are tangential and axial views, respectively, of a bucket constructed in accordance with the present invention and illustrating its aerodynamic profile.
Figure 2:
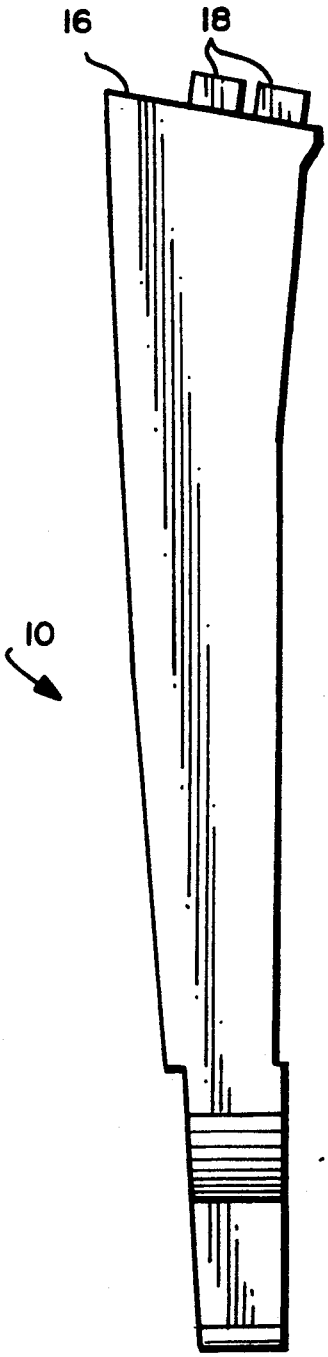

Referring to drawing FIGS. 1 and 2, the bucket of the present invention is generally designated 10 and has a root 12 connected to a pine tree dovetail 14 for connection to the wheel of the turbine, not shown. Bucket 10 also includes a tip 16 having covers, not shown, connected to the tips by tenons 18.

Figure 3:
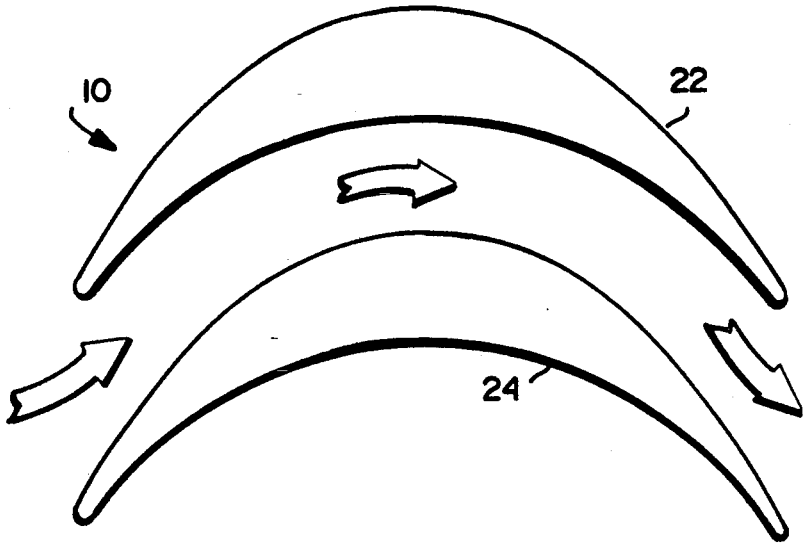
FIG. 3 is a schematic illustration of a cross-section of an adjacent pair of buckets illustrating the flow between the buckets.

In FIG. 3, the airfoil outlines of the buckets, i.e., the outlines illustrated at 22 and 24, represent the aerodynamically efficient cross-section for the bucket profile of the present invention at a predetermined radial distance from the bucket root. The flow is illustrated by the arrows and is globally convergent from the leading edges to the trailing edges.

Figure 4:
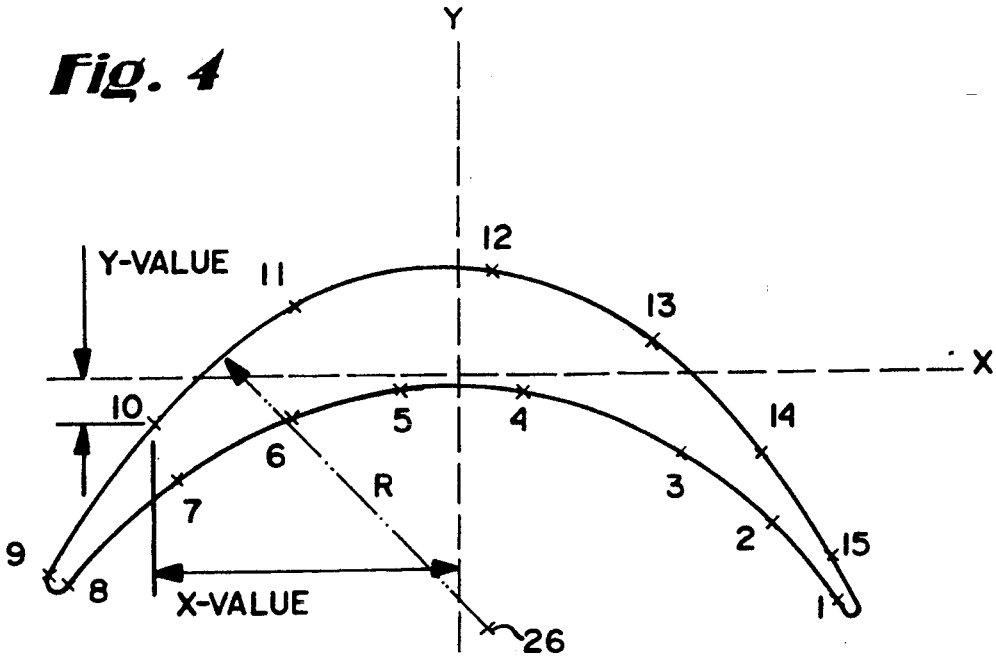
FIG. 4 is a graph illustrating a representative airfoil section of the bucket profile as defined by the Charts set forth in Table I of the following specification.

Referring now to FIG. 4, there is illustrated a representative bucket section profile at a predetermined radial distance from the root section. This radial distance is taken from a datum line D.L. at the intersection of the bucket root section 12 at its trailing edge and the pine tree dovetail 14 as illustrated in FIG. 1 and taken along a line perpendicular the axis of rotation of the turbine. Each profile section at that radial distance is defined in X-Y coordinates by adjacent points identified by representative numerals, for example, numerals 1 through 15 in the drawing Figure, and which adjacent points are connected one to the other along the arcs of circles having radii R. For example, the arc connecting points 10 and 11 constitutes a portion of a circle having a radius R and a center at 26 as illustrated. Values of the X-Y coordinates and the radii R for each bucket section profile taken at specific radial locations or heights from the root section of the bucket are tabulated in the following charts. The charts identify the various points along a profile section at the given radial distance from the root section by their X-Y coordinates and it will be seen that the charts have anywhere from 14 to 27 representative X-Y coordinate points, depending upon the profile section height from the root. These values are given in inches and represent actual bucket configuration at ambient non-operating conditions (with the exception of the coordinate points noted below). The value for each radius R provides the length of the radius defining the arc of the circle between two of the adjacent points identified by the X-Y coordinates. The sign convention assigns a positive value to the radius R when the adjacent two points are connected in a clockwise direction and a negative value to the radius R when the adjacent two points are connected in a counterclockwise direction. By providing X-Y coordinates for spaced points about the blade profile at selected radial positions or heights from the root section and defining the radii of circles connecting adjacent points, the profile of the bucket is defined at each radial position and thus the bucket profile is defined throughout its entire length.

Chart I represents the theoretical profile of the bucket at the datum line D.L along the root. From a review of the drawing Figures, it will be appreciated that the transition between the dovetail and the bucket vane is angled and provided by a root fillet. Therefore, the actual profile at the bucket base or root is not given but the theoretical profile of the bucket at the base or root along datum line D.L is given in Chart I. Similarly, the actual profile at the tip of the bucket is not given. Rather, the theoretical aerodynamic profile is given in Chart XVII for the tip. It will be appreciated that the tip may have built-up portions for structural and other reasons.

It will be appreciated that having defined the profile of the bucket at various selected heights from the root, properties of the bucket such as the maximum and minimum moments of inertia, the area of the bucket at each section, the twist, torsional stiffness, sheer centers, vane width, can be ascertained.

Charts I-XVII inclusive identify the theoretical profiles of a bucket at the identified distances from the root. Charts II-XVI identify the actual and theoretical profiles of a bucket at the identified distances from the root.

CHART I

| | 25 SECTION BT. FROM ROOT: 0. | | |
|---|---|---|---|
| PT. NO. | X | Y | R |
| 1 | 1.4945 | −1.0842 | 0. |
| 2 | 1.4935 | −1.0820 | −0.4263 |
| 3 | 1.4827 | −1.0592 | −0.6520 |
| 4 | 1.4708 | −1.0368 | −1.6432 |
| 5 | 1.1547 | −0.6345 | −1.9402 |
| 6 | 0.8263 | −0.3887 | −1.5777 |
| 7 | 0.5343 | −0.2532 | −2.0240 |
| 8 | 0.2338 | −0.1747 | −1.3636 |
| 9 | −0.0172 | −0.1530 | −1.7925 |
| 10 | −1.1100 | −0.5335 | −1.2846 |
| 11 | −1.3645 | −0.7994 | 0.1510 |
| 12 | −1.4101 | −0.8414 | 0.0489 |
| 13 | −1.4832 | −0.7896 | 1.9789 |
| 14 | −1.3196 | −0.3105 | 2.4762 |
| 15 | −1.1373 | 0.0005 | 1.8210 |
| 16 | −0.6990 | 0.4473 | 1.2081 |
| 17 | −0.1413 | 0.6650 | 1.0299 |
| 18 | 0.4246 | 0.5734 | 1.3775 |
| 19 | 0.8464 | 0.2635 | 2.2453 |
| 20 | 1.0453 | 0.0151 | 0. |
| 21 | 1.0771 | −0.0309 | 3.7787 |
| 22 | 1.4011 | −0.6003 | 3.6161 |
| 23 | 1.5623 | −1.0175 | 0. |
| 24 | 1.5739 | −1.0543 | 0.0425 |
| 25 | 1.4945 | −1.0842 | 0. |

CHART II

| | SECTION HT. FROM ROOT: 0.938 | | |
|---|---|---|---|
| PT. NO. | X | Y | R |
| 1 | −1.3626 | −0.6942 | 0.0533 |
| 2 | −1.4365 | −0.6345 | 1.6867 |
| 3 | −1.1933 | −0.0547 | 1.6715 |
| 4 | −0.6212 | 0.5053 | 1.0678 |
| 5 | 0.1752 | 0.6204 | 1.2733 |
| 6 | 0.7879 | 0.2332 | 2.9242 |
| 7 | 1.0638 | −0.1431 | 4.2363 |
| 8 | 1.5262 | −1.1511 | 0.0408 |

CHART II-continued

| | SECTION HT. FROM ROOT: 0.938 | | |
|---|---|---|---|
| PT. NO. | X | Y | R |
| 9 | 1.4499 | −1.1798 | 0. |
| 10 | 1.4460 | −1.1710 | −1.1939 |
| 11 | 1.3680 | −1.0248 | −2.1083 |
| 12 | 0.8460 | −0.4601 | −1.6610 |
| 13 | −0.6898 | −0.2456 | −1.3449 |
| 14 | −1.2947 | −0.6391 | 0.1708 |
| 15 | −1.3626 | −0.6942 | 0. |

CHART III

| | SECTION HT. FROM ROOT: 1.875 | | |
|---|---|---|---|
| PT. NO. | X | Y | R |
| 1 | 1.4041 | −1.2718 | 0. |
| 2 | 1.4041 | −1.2717 | 0.4945 |
| 3 | 1.4039 | −1.2712 | 0.9362 |
| 4 | 1.4003 | −1.2624 | 2.5092 |
| 5 | 1.3977 | −1.2562 | −1.3672 |
| 6 | 1.3963 | −1.2526 | −0.9477 |
| 7 | 1.3465 | −1.1486 | 3.9682 |
| 8 | 1.3298 | −1.1183 | −1.1401 |
| 9 | 1.2968 | −1.0617 | −2.5543 |
| 10 | 0.9581 | −0.6291 | −1.6511 |
| 11 | −0.6068 | −0.1745 | 0. |
| 12 | −0.6762 | −0.1910 | −1.2013 |
| 13 | −1.2477 | −0.5102 | 0.1678 |
| 14 | −1.3154 | −0.5514 | 0.0587 |
| 15 | −1.3907 | −0.4832 | 1.2906 |
| 16 | −1.2700 | −0.1498 | 1.7583 |
| 17 | −1.0192 | 0.2091 | 1.4533 |
| 18 | −0.5764 | 0.5418 | 1.0053 |
| 19 | 0.3129 | 0.5368 | 1.3516 |
| 20 | 0.7552 | 0.1828 | 2.2594 |
| 21 | 0.9079 | −0.0279 | 0. |
| 22 | 0.9476 | −0.0899 | 4.4312 |
| 23 | 1.3042 | −0.7704 | 5.5460 |
| 24 | 1.4506 | −1.1612 | 3.3803 |
| 25 | 1.4735 | −1.2328 | 0. |
| 26 | 1.4772 | −1.2452 | 0.0390 |
| 27 | 1.4041 | −1.2718 | 0. |

CHART IV

| | SECTION HT. FROM ROOT: 2.813 | | |
|---|---|---|---|
| PT. NO. | X | Y | R |
| 1 | −1.2718 | −0.4154 | 0.0630 |
| 2 | −1.3451 | −0.3391 | 1.1223 |
| 3 | −1.2507 | −0.0827 | 1.4030 |
| 4 | −0.6117 | 0.5399 | 0.9655 |
| 5 | 0.1867 | 0.5578 | 1.2762 |
| 6 | 0.6915 | 0.1691 | 2.7986 |
| 7 | 0.8842 | −0.1116 | 5.4809 |
| 8 | 1.4275 | −1.3339 | 0.0372 |
| 9 | 1.3574 | −1.3585 | 0. |
| 10 | 1.3404 | −1.3159 | −0.9810 |
| 11 | 1.2973 | −1.2229 | −3.8684 |
| 12 | 1.1944 | −1.0404 | −2.1207 |
| 13 | 0.6429 | −0.4307 | −1.6361 |
| 14 | −0.2173 | −0.1107 | −1.7395 |
| 15 | −0.7398 | −0.1523 | −1.0984 |
| 16 | −1.1912 | −0.3772 | 0.1789 |
| 17 | −1.2718 | −0.4154 | 0. |

CHART V

| | SECTION HT. FROM ROOT: 3.750 | | |
|---|---|---|---|
| PT. NO. | X | Y | R |
| 1 | 1.3090 | −1.4397 | 0. |
| 2 | 1.3088 | −1.4391 | 1.2104 |
| 3 | 1.3066 | −1.4336 | 2.8272 |
| 4 | 1.2978 | −1.4114 | 13.1592 |
| 5 | 1.2930 | −1.3991 | 0. |
| 6 | 1.2731 | −1.3482 | −0.3285 |
| 7 | 1.2594 | −1.3177 | 0. |
| 8 | 1.1842 | −1.1710 | −2.1649 |

CHART V-continued

| SECTION HT. FROM ROOT: 3.750 | | | |
|---|---|---|---|
| PT. NO. | X | Y | R |
| 9 | 0.8609 | −0.7037 | −2.3629 |
| 10 | 0.4759 | −0.3627 | −1.5189 |
| 11 | 0.1380 | −0.1828 | −1.6882 |
| 12 | −0.7812 | −0.1032 | −0.9361 |
| 13 | −1.1399 | −0.2549 | 0.1809 |
| 14 | −1.2298 | −0.2869 | 0.0677 |
| 15 | −1.3008 | −0.2041 | 0.8694 |
| 16 | −1.1925 | 0.0579 | 1.2751 |
| 17 | −0.6208 | 0.5531 | 0.9252 |
| 18 | 0.0473 | 0.5818 | 1.2100 |
| 19 | 0.5678 | 0.2345 | 1.7013 |
| 20 | 0.7376 | 0.0051 | 0. |
| 21 | 0.7748 | −0.0552 | 4.5332 |
| 22 | 1.0156 | −0.4988 | 9.4871 |
| 23 | 1.1882 | −0.8860 | 5.0418 |
| 24 | 1.3717 | −1.4003 | 0. |
| 25 | 1.3764 | −1.4161 | 0.0357 |
| 26 | 1.3090 | −1.4397 | 0. |

CHART VI

| SECTION HT. FROM ROOT: 4.688 | | | |
|---|---|---|---|
| PT. NO. | X | Y | R |
| 1 | −1.1909 | −0.1649 | 0.0710 |
| 2 | −1.2566 | −0.0763 | 0.7768 |
| 3 | −1.0632 | 0.2704 | 1.0926 |
| 4 | −0.5212 | 0.6034 | 0.9149 |
| 5 | 0.0028 | 0.5745 | 1.1870 |
| 6 | 0.6049 | 0.1080 | 2.9765 |
| 7 | 0.7946 | −0.2109 | 7.1795 |
| 8 | 1.1500 | −0.9885 | 5.5561 |
| 9 | 1.3236 | −1.4915 | 0.0343 |
| 10 | 1.2586 | −1.5135 | 0. |
| 11 | 1.2337 | −1.4493 | −1.8219 |
| 12 | 1.1635 | −1.2926 | −2.4852 |
| 13 | 0.5534 | −0.4691 | −1.6839 |
| 14 | −0.0076 | −0.1300 | −1.6713 |
| 15 | −0.6789 | −0.0275 | −0.9102 |
| 16 | −1.0847 | −0.1375 | 0.1873 |
| 17 | −1.1909 | −0.1649 | 0. |

CHART VII

| SECTION HT. FROM ROOT: 5.625 | | | |
|---|---|---|---|
| PT. NO. | X | Y | R |
| 1 | 1.2054 | −1.5813 | 5.0573 |
| 2 | 1.2026 | −1.5739 | 10.0261 |
| 3 | 1.1959 | −1.5567 | 0. |
| 4 | 1.1815 | −1.5194 | −2.7328 |
| 5 | 1.0905 | −1.3098 | −28.4285 |
| 6 | 1.0742 | −1.2762 | 35.4925 |
| 7 | 1.0625 | −1.2522 | −3.1400 |
| 8 | 0.8397 | −0.8658 | −2.3097 |
| 9 | 0.2783 | −0.2865 | −1.5187 |
| 10 | 0.0691 | −0.1597 | −2.1164 |
| 11 | −0.2689 | −0.0254 | −1.4477 |
| 12 | −0.7545 | 0.0343 | −0.8424 |
| 13 | −1.0495 | −0.0342 | 0.1882 |
| 14 | −1.1555 | −0.0471 | 0.0745 |
| 15 | −1.2149 | 0.0464 | 0.6369 |
| 16 | −1.0614 | 0.3159 | 1.1277 |
| 17 | −0.7639 | 0.5381 | 0.8695 |
| 18 | −0.1014 | 0.5939 | 1.2888 |
| 19 | 0.2428 | 0.4243 | 1.0870 |
| 20 | 0.5209 | 0.1438 | 2.8596 |
| 21 | 0.7019 | −0.1608 | 8.5528 |
| 22 | 1.2171 | −1.3926 | 3.7532 |
| 23 | 1.2630 | −1.5425 | 0. |
| 24 | 1.2680 | −1.5604 | 0.0330 |
| 25 | 1.2054 | −1.5813 | 0. |

CHART VIII

| SECTION HT. FROM ROOT: 6.563 | | | |
|---|---|---|---|
| PT. NO. | X | Y | R |
| 1 | −1.1249 | 0.0702 | 0.0765 |
| 2 | −1.1753 | 0.1673 | 0.5453 |
| 3 | −1.0218 | 0.4025 | 0.9654 |
| 4 | −0.4607 | 0.6462 | 0.9043 |
| 5 | −0.1043 | 0.5925 | 1.1491 |
| 6 | 0.4840 | 0.1091 | 4.2116 |
| 7 | 0.6711 | −0.2345 | 8.9785 |
| 8 | 1.1806 | −1.5299 | 0. |
| 9 | 1.2087 | −1.6219 | 0.0320 |
| 10 | 1.1484 | −1.6428 | 0. |
| 11 | 1.1093 | −1.5413 | −3.2334 |
| 12 | 1.0313 | −1.3564 | 0. |
| 13 | 0.9779 | −1.2400 | −2.7877 |
| 14 | 0.4645 | −0.4817 | −2.0302 |
| 15 | −0.1501 | −0.0398 | −1.6053 |
| 16 | −0.6559 | 0.1009 | −0.9411 |
| 17 | −1.0177 | 0.0694 | 0.1882 |
| 18 | −1.1249 | 0.0702 | 0. |

CHART IX

| SECTION HT. FROM ROOT: 7.500 | | | |
|---|---|---|---|
| PT. NO. | X | Y | R |
| 1 | 1.0903 | −1.6948 | −6.7527 |
| 2 | 0.9778 | −1.4098 | 0. |
| 3 | 0.9477 | −1.3383 | −3.2991 |
| 4 | 0.5031 | −0.5830 | −2.2548 |
| 5 | −0.1599 | −0.0125 | −1.6014 |
| 6 | −0.6610 | 0.1693 | −0.9996 |
| 7 | −0.9885 | 0.1746 | 0.1821 |
| 8 | −1.0929 | 0.1899 | 0.0789 |
| 9 | −1.1328 | 0.2903 | 0.4387 |
| 10 | −1.0126 | 0.4604 | 0.7918 |
| 11 | −0.6913 | 0.6296 | 1.1839 |
| 12 | −0.5315 | 0.6595 | 0.7873 |
| 13 | −0.1823 | 0.6213 | 1.1150 |
| 14 | 0.3864 | 0.1766 | 1.6407 |
| 15 | 0.4441 | 0.0811 | 0. |
| 16 | 0.4992 | −0.0175 | 4.1160 |
| 17 | 0.6849 | −0.3937 | 16.7423 |
| 18 | 0.8796 | −0.8643 | 7.7329 |
| 19 | 1.1245 | −1.5844 | 5.0152 |
| 20 | 1.1473 | −1.6666 | 0. |
| 21 | 1.1498 | −1.6760 | 0.0313 |
| 22 | 1.0903 | −1.6948 | 0. |

CHART X

| SECTION Ht. FROM ROOT: 8.438 | | | |
|---|---|---|---|
| PT. NO. | X | Y | R |
| 1 | −1.0556 | 0.3149 | 0.0799 |
| 2 | −1.0812 | 0.4185 | 0.4152 |
| 3 | −0.9086 | 0.5906 | 0.7603 |
| 4 | −0.5146 | 0.6932 | 0.8684 |
| 5 | −0.0539 | 0.5648 | 1.0748 |
| 6 | 0.3382 | 0.1752 | 4.7775 |
| 7 | 0.6277 | −0.3871 | 10.2170 |
| 8 | 0.9488 | −1.2248 | 9.6164 |
| 9 | 1.0925 | −1.7191 | 0.0308 |
| 10 | 1.0337 | −1.7373 | −5.8571 |
| 11 | 0.9660 | −1.5583 | −4.3863 |
| 12 | 0.5698 | −0.7573 | −2.4062 |
| 13 | 0.0044 | −0.1169 | −2.0911 |
| 14 | −0.4059 | 0.1489 | −1.3435 |
| 15 | −0.9511 | 0.2850 | 0.1746 |
| 16 | −1.0556 | 0.3149 | 0. |

CHART XI

| SECTION HT. FROM ROOT: 9.375 | | | |
|---|---|---|---|
| PT. NO. | X | Y | R |
| 1 | 0.9770 | −1.7754 | 0. |
| 2 | 0.9763 | −1.7735 | −2.5997 |
| 3 | 0.9621 | −1.7332 | −6.1767 |

CHART XI-continued

SECTION HT. FROM ROOT: 9.375

| PT. NO. | X | Y | R |
|---|---|---|---|
| 4 | 0.9315 | −1.6508 | −34.1166 |
| 5 | 0.9180 | −1.6154 | 111.8107 |
| 6 | 0.8984 | −1.5636 | −5.2707 |
| 7 | 0.4524 | −0.6607 | −2.3550 |
| 8 | 0.1950 | −0.3188 | −3.3801 |
| 9 | −0.2414 | 0.0848 | −1.6663 |
| 10 | −0.9385 | 0.4015 | 0.1598 |
| 11 | −1.0177 | 0.4425 | 0.0813 |
| 12 | −1.0278 | 0.5488 | 0.3836 |
| 13 | −0.8832 | 0.6705 | 0.7191 |
| 14 | −0.5275 | 0.7411 | 0. |
| 15 | −0.5122 | 0.7402 | 0.7997 |
| 16 | −0.1703 | 0.6405 | 1.2411 |
| 17 | 0.0453 | 0.4884 | 1.0732 |
| 18 | 0.2308 | 0.2759 | 1.6442 |
| 19 | 0.3091 | 0.1454 | −3.8595 |
| 20 | 0.3538 | 0.0646 | 4.3514 |
| 21 | 0.5884 | −0.4135 | 12.0904 |
| 22 | 0.7736 | −0.8854 | 6.5635 |
| 23 | 0.9291 | −1.3628 | 16.5364 |
| 24 | 1.0072 | −1.6477 | 7.5214 |
| 25 | 1.0316 | −1.7424 | 0. |
| 26 | 1.0355 | −1.7580 | 0.0305 |
| 27 | 0.9770 | −1.7754 | 0. |

CHART XII

SECTION HT. FROM ROOT: 10.313

| PT. NO. | X | Y | R |
|---|---|---|---|
| 1 | −0.9848 | 0.5710 | 0.0799 |
| 2 | −0.9779 | 0.6751 | 0.3968 |
| 3 | −0.7792 | 0.7846 | 0.8005 |
| 4 | −0.0781 | 0.6010 | 1.3625 |
| 5 | 0.2138 | 0.2341 | 0. |
| 6 | 0.3275 | 0.0254 | 4.4862 |
| 7 | 0.5515 | −0.4498 | 9.3243 |
| 8 | 0.9772 | −1.7976 | 0.0308 |
| 9 | 0.9181 | −1.8143 | −6.4715 |
| 10 | 0.7230 | −1.2999 | −5.3205 |
| 11 | 0.4584 | −0.7668 | −3.5831 |
| 12 | −0.1572 | 0.0300 | −2.2780 |
| 13 | −0.9171 | 0.5196 | 0.1557 |
| 14 | −0.9848 | 0.5710 | 0. |

CHART XIII

SECTION HT. FROM ROOT: 11.250

| PT. NO. | X | Y | R |
|---|---|---|---|
| 1 | 0.8608 | −1.8496 | 0. |
| 2 | 0.8606 | −1.8488 | −1.6990 |
| 3 | 0.8525 | −1.8240 | −3.3045 |
| 4 | 0.8375 | −1.7803 | −11.2036 |
| 5 | 0.8280 | −1.7532 | 0. |
| 6 | 0.8231 | −1.7393 | 7.5360 |
| 7 | 0.8049 | −1.6871 | 0. |
| 8 | 0.7948 | −1.6577 | −3.9554 |
| 9 | 0.7850 | −1.6296 | 0. |
| 10 | 0.7627 | −1.5665 | −5.2131 |
| 11 | 0.0059 | −0.1590 | −2.9637 |
| 12 | −0.7571 | 0.5478 | −27.7124 |
| 13 | −0.8504 | 0.6075 | 8.4649 |
| 14 | −0.9021 | 0.6406 | 0.1358 |
| 15 | −0.9492 | 0.6927 | 0.0795 |
| 16 | −0.9275 | 0.7916 | 0.3804 |
| 17 | −0.7149 | 0.8720 | 0.8382 |
| 18 | −0.2580 | 0.7674 | 0.6878 |
| 19 | −0.0642 | 0.6067 | 1.7789 |
| 20 | 0.1522 | 0.2788 | −8.0502 |
| 21 | 0.2550 | 0.0845 | 4.4833 |
| 22 | 0.5262 | −0.5112 | 10.7721 |
| 23 | 0.8415 | −1.5113 | 8.2967 |
| 24 | 0.8937 | −1.7216 | 0. |
| 25 | 0.9200 | −1.8333 | 0.0307 |
| 26 | 0.8608 | −1.8496 | 0. |

CHART XIV

SECTION HT. FROM ROOT: 12.188

| PT. NO. | X | Y | R |
|---|---|---|---|
| 1 | −0.9030 | 0.8061 | 0.0751 |
| 2 | −0.8691 | 0.8937 | 0.3979 |
| 3 | −0.6585 | 0.9472 | 0.7483 |
| 4 | −0.0488 | 0.6021 | 2.8926 |
| 5 | 0.0990 | 0.3421 | 7.2530 |
| 6 | 0.1091 | 0.3218 | 0. |
| 7 | 0.2320 | 0.0750 | 5.1970 |
| 8 | 0.4663 | −0.4717 | 10.9617 |
| 9 | 0.8677 | −1.8592 | 0.0312 |
| 10 | 0.8075 | −1.8756 | 0. |
| 11 | 0.7522 | −1.7075 | −6.2571 |
| 12 | −0.0519 | −0.0948 | −3.5118 |
| 13 | −0.6870 | 0.5989 | 0. |
| 14 | −0.8617 | 0.7446 | 0.1319 |
| 15 | −0.9030 | 0.8061 | 0. |

CHART XV

SECTION HT. FROM ROOT: 13.125

| PT. NO. | X | Y | R |
|---|---|---|---|
| 1 | −0.8483 | 0.9088 | 0.0715 |
| 2 | −0.8070 | 0.9857 | 0.3588 |
| 3 | −0.6372 | 1.0164 | 0.6771 |
| 4 | −0.1450 | 0.7553 | 1.3383 |
| 5 | 0.0079 | 0.5057 | −66.0867 |
| 6 | 0.1801 | 0.1426 | 4.5224 |
| 7 | 0.3555 | −0.2773 | 17.4206 |
| 8 | 0.5485 | −0.8443 | 8.3362 |
| 9 | 0.6929 | −1.3475 | 18.6028 |
| 10 | 0.7927 | −1.7614 | 9.7675 |
| 11 | 0.8143 | −1.8577 | 0. |
| 12 | 0.8185 | −1.8771 | 0.0315 |
| 13 | 0.7578 | −1.8933 | 0. |
| 14 | 0.7024 | −1.7181 | −1.2154 |
| 15 | 0.6929 | −1.6892 | −6.4831 |
| 16 | 0.6624 | −1.6026 | −9.4151 |
| 17 | 0.4082 | −0.9691 | −6.9382 |
| 18 | −0.3079 | 0.2769 | −2.9403 |
| 19 | −0.6204 | 0.6424 | 0. |
| 20 | −0.7392 | 0.7603 | 1.1315 |
| 21 | −0.8271 | 0.8584 | 0.1180 |
| 22 | −0.8483 | 0.9088 | 0. |

CHART XVI

SECTION HT. FROM ROOT: 14.063

| PT. NO. | X | Y | R |
|---|---|---|---|
| 1 | −0.7896 | 1.0109 | 0.0641 |
| 2 | −0.7444 | 1.0724 | 0.3435 |
| 3 | −0.5355 | 1.0701 | 0.6636 |
| 4 | −0.2327 | 0.8866 | 1.0490 |
| 5 | −0.0513 | 0.6239 | 1.9226 |
| 6 | 0.0232 | 0.4628 | 0. |
| 7 | 0.1245 | 0.2295 | 6.1060 |
| 8 | 0.3708 | −0.4334 | 13.5292 |
| 9 | 0.6519 | −1.3792 | 14.3725 |
| 10 | 0.7714 | −1.8902 | 0.0321 |
| 11 | 0.7093 | −1.9062 | 0. |
| 12 | 0.6580 | −1.7367 | −10.2906 |
| 13 | −0.2448 | 0.2275 | −3.2907 |
| 14 | −0.6423 | 0.7795 | 0. |
| 15 | −0.6839 | 0.8272 | 0.6665 |
| 16 | −0.7650 | 0.9367 | 0.1256 |
| 17 | −0.7896 | 1.0109 | 0. |

CHART XVII

SECTION HT. FROM ROOT: 15.000

| PT. NO. | X | Y | R |
|---|---|---|---|
| 1 | 0.6620 | −1.9161 | 0. |
| 2 | 0.6602 | −1.9093 | −2.1256 |
| 3 | 0.6369 | −1.8263 | −7.1384 |
| 4 | 0.4575 | −1.3074 | −15.8725 |
| 5 | 0.1250 | −0.5170 | 0. |

CHART XVII-continued

| SECTION HT. FROM ROOT: 15.000 | | | |
|---|---|---|---|
| PT. NO. | X | Y | R |
| 6 | −0.0605 | −0.1074 | −7.9591 |
| 7 | −0.3650 | 0.4954 | −2.9117 |
| 8 | −0.6008 | 0.8524 | 0. |
| 9 | −0.6546 | 0.9222 | 0.4265 |
| 10 | −0.7269 | 1.0651 | 0.1026 |
| 11 | −0.7301 | 1.1059 | 0.0601 |
| 12 | −0.6819 | 1.1576 | 0.2847 |
| 13 | −0.5371 | 1.1481 | 0.5902 |
| 14 | −0.2762 | 0.9721 | 0. |
| 15 | −0.2552 | 0.9476 | 1.3563 |
| 16 | −0.0610 | 0.6484 | 2.5961 |
| 17 | 0.0036 | 0.5010 | 0. |
| 18 | 0.0710 | 0.3331 | 6.8066 |
| 19 | 0.2577 | −0.1934 | 70.9096 |
| 20 | 0.4033 | −0.6703 | 19.4969 |

CHART XVII-continued

| SECTION HT. FROM ROOT: 15.000 | | | |
|---|---|---|---|
| PT. NO. | X | Y | R |
| 21 | 0.6209 | −1.4505 | 9.7641 |
| 22 | 0.7214 | −1.8829 | 0. |
| 23 | 0.7253 | −1.9013 | 0.0325 |
| 24 | 0.6620 | −1.9161 | 0. |

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. A bucket for a steam turbine having a profile in accordance with Charts II–XVI.

2. A bucket for a steam turbine having a profile in accordance with Charts I–XVII.

* * * * *